US008708871B2

(12) United States Patent
Thulin

(10) Patent No.: US 8,708,871 B2
(45) Date of Patent: Apr. 29, 2014

(54) TRAINING MACHINE FOR STRENGTH TRAINING AND REHABILITATION

(76) Inventor: Mats Thulin, Lindingö (SE)

( * ) Notice: Subject to any disclaimer, the term of this patent is extended or adjusted under 35 U.S.C. 154(b) by 334 days.

(21) Appl. No.: 12/893,027

(22) Filed: Sep. 29, 2010

(65) Prior Publication Data

US 2011/0105284 A1 May 5, 2011

(30) Foreign Application Priority Data

Nov. 3, 2009 (SE) ..... 0950821

(51) Int. Cl.
*A63B 21/062* (2006.01)
*A63B 21/00* (2006.01)

(52) U.S. Cl.
USPC ..... 482/100; 482/98; 482/137

(58) Field of Classification Search
USPC ..... 482/94, 98, 101, 102, 112, 93, 95, 96, 482/99, 100, 133–138
See application file for complete search history.

(56) References Cited

U.S. PATENT DOCUMENTS

| | | | | |
|---|---|---|---|---|
| 4,600,188 | A * | 7/1986 | Bangerter et al. | 482/79 |
| 4,609,189 | A | 9/1986 | Brasher | |
| 4,765,611 | A | 8/1988 | MacMillan | |
| 5,336,148 | A * | 8/1994 | Ish, III | 482/98 |
| 5,749,813 | A * | 5/1998 | Domzalski | 482/97 |
| 6,482,135 | B1 * | 11/2002 | Ish et al. | 482/97 |
| 2007/0149367 | A1 * | 6/2007 | Thulin | 482/100 |

FOREIGN PATENT DOCUMENTS

| | | |
|---|---|---|
| GB | 2227676 A | 8/1990 |
| WO | 2007037755 A1 | 4/2007 |

* cited by examiner

*Primary Examiner* — Oren Ginsberg
*Assistant Examiner* — Sundhara Ganesan
(74) *Attorney, Agent, or Firm* — Jeffrey S. Melcher; Manelli Selter PLLC

(57) ABSTRACT

The invention relates to a training machine for strength training and rehabilitation comprising pull or press means (42, 43), which are arranged to be moved to and fro, while a predetermined number of weights (18) of a weight package via connection means (22) are brought to be lifted and lowered, respectively, along an inner frame (8), and driving means (48, 49, 50) for lifting said predetermined number of weights in a continuous cycle by means of a first user force towards said pull or press means, and for lowering said predetermined number of weights by means of a second user force, wherein said first force is smaller than said second force. The inner frame is turnable along a substantially horizontal axis of oscillation (9), which is arranged at the lower end of the inner frame and said driving means (48, 49, 50) is arranged at a predetermined distance above the geometric center of the inner frame, so that the upper end of the inner frame is arranged to be moved to and fro from a predetermined angled position turned about said axis and an essentially vertical position.

7 Claims, 5 Drawing Sheets

TRAINING MACHINE FOR STRENGTH TRAINING AND REHABILITATION

This application claims priority under 35 USC 119 to Swedish Patent Application No. 0950821-9, filed on 3 Nov. 2009, the complete disclosure of which is incorporated herein by reference.

The present invention relates to a training machine for strength training and rehabilitation of the kind described in the preamble of claim 1.

Previously known training machines of the kind mentioned above include most known training machines where the user loads the muscles intended in its body by performing predetermined movements so that weights in a weight stack are lifted or lowered. At efficient training with both single-joint movements, such as by a biceps curl machine or a leg kick machine, and with multiple-joint movements, such as by a rowing machine, a bench press machine or a leg press machine, it is important that the user of the machine can perform a number of positive and negative working cycles intended for the personal capacity. The positive work implies that weights are being lifted and the negative work implies that weights are being lowered.

In U.S. Pat. No. 4,609,189, a training machine is described which consists of a weight stack which is articulated at the bottom by means of pivots arranged on each side of the weight stack. Hence, the entire weight stack may be moved between a vertical position and a predetermined inclined position by means of a motor being able to turn one of the pivots. In the inclined position, the positive movement is performed as it will be "lighter" for the user to lift the weights in the weight stack. When the user has moved the weights to an end position, the weight stack is moved to its vertical position, wherein it will be "heavier" for the user in the negative movement to return the weights to the original position. Then, the same cycle is repeated a number of times. In the construction described in U.S. Pat. No. 4,609,189, the motor has to be very powerful to be able to lift the weight stack from the inclined position and up to the vertical position. In addition, a considerable force is required to keep the stack in the inclined position after the movement from the vertical position. Such a construction has to be oversized to a very large extent to last during the life of the machine.

In U.S. Pat. No. 4,765,611 a training machine is described wich is turnable between different positions to effect different forces in the positive and negative movements. This machine is very complicated with regard to its construction and also to its function.

A training machine is known through WO 2007/037755, at which pivots for a turnable weight stack are arranged at the centre of the weight stack, wherein a motor at the lower end of the stack is arranged to push the stack between a vertical position and a predetermined inclined position.

GB-A-2227676 describes a device for increasing the weight at a machine to enable that the machine can be loaded additionally, without the need of exchanging weights, so it can be used by both beginners and well-trained persons. This exchange takes place by means of an additional device with a lever system and a gas spring and may be performed between the exercises. Thus, one person will not be able to change the mass of weight considerably during use.

To change the load with the machine described in the preamble together with a device according to GB-A-2227676 described above, the user must take a break and change the mass of weight by means of the additional device. However, this implies that an optimal training cannot be achieved without it being possible to reduce the total weight of the machine.

The object of the present invention is to provide a training machine of the kind mentioned in the preamble, at which the drawbacks with known machines mentioned above can be overcome and which is simple with regard both to construction and function.

The object is achieved with a training machine which has the features according to the characterizing portion of claim 1.

Preferred embodiments of the training machine according to the invention have the characteristics set forth in the subclaims.

By varying the load so that the positive cycle will be lighter to perform, i.e. a smaller force is required to lift the weights than to lower them during the same movement cycle, the training person can lift a larger number of weights than is possible with a normal machine. Possibly, a training session can alternatively be performed in such a manner that a person can perform lifts more times than previously with the same number of weights.

The problems with conventional training machines where one lowers and lifts the same number of weights is that such a training machine do not consider the negative—the lowering force is larger than the positive one—lifting force. Consequently, the efficiency of such a training machine is limited. At the training with conventional training machines the number of weights has to be chosen in accordance with the weaker, lifting force. The same number of weights is then lowered at the negative portion of the movement. This number of weights is not on a level with the negative force.

With the training machine according to the invention, the negative force can be practised with a more optimal weight. The result will be that the fatigue rate of the muscle trained increases. With this invention, it is possible to stimulate a capacity improvement with a less training amount than at training with conventional training machines. Scientific studies have proved that training where the weight is adapted to the negative force gives a quicker and larger strength growth than training where the weight is adapted to the positive force.

By mounting the motor above the horizontal centre of the frame supporting the weight stack, specially at the upper end of this frame, a smaller motor may be used to move the weight stack between the vertical position and the predetermined inclined position, and vice versa.

The invention will below be described more in detail with reference to the accompanying drawings, which show a preferred embodiment.

Figure 1:
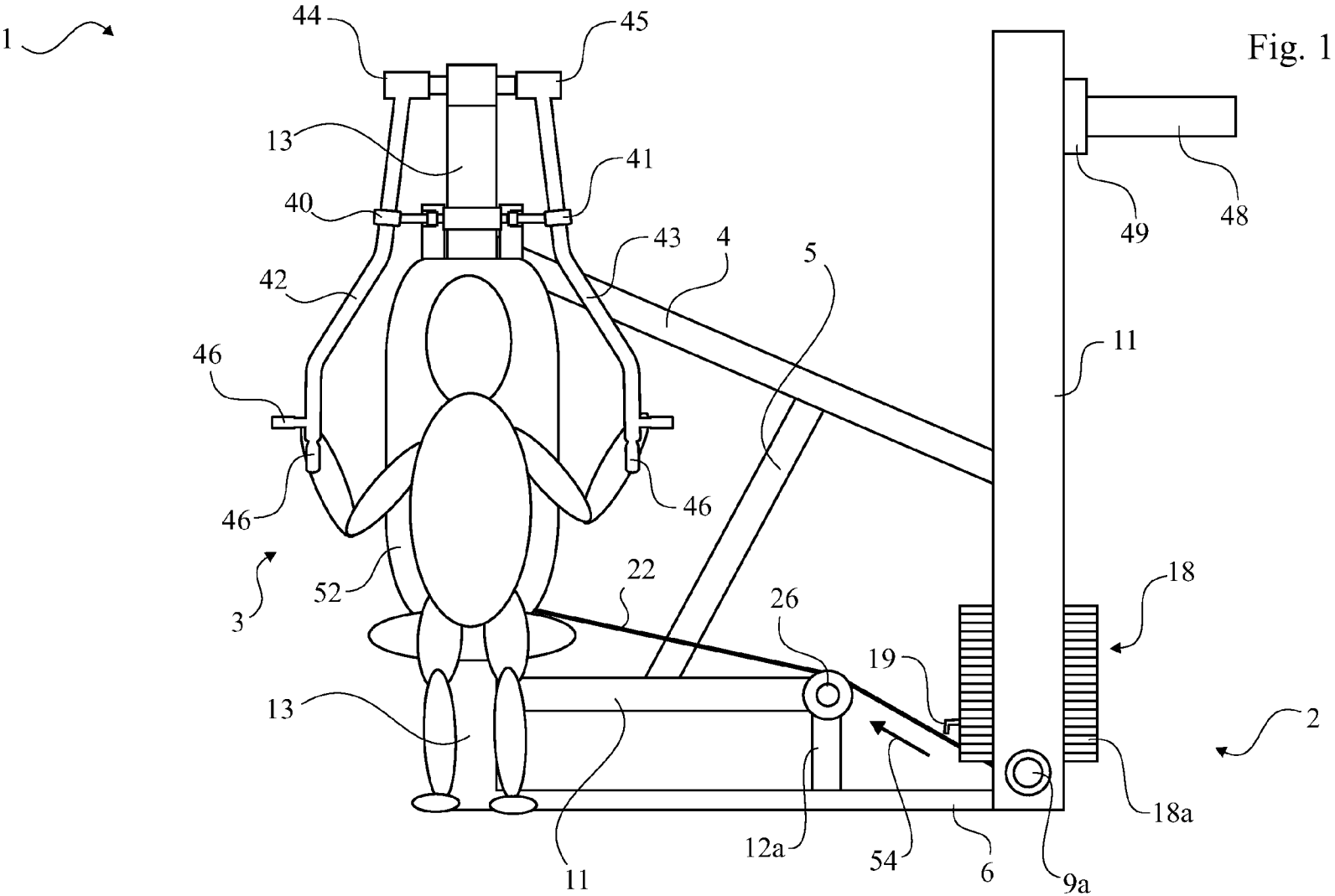
FIG. 1 shows a front view of an embodiment of a traning machine for strength training and rehabilitation according to the invention in a negative movement position.
Figure 2:
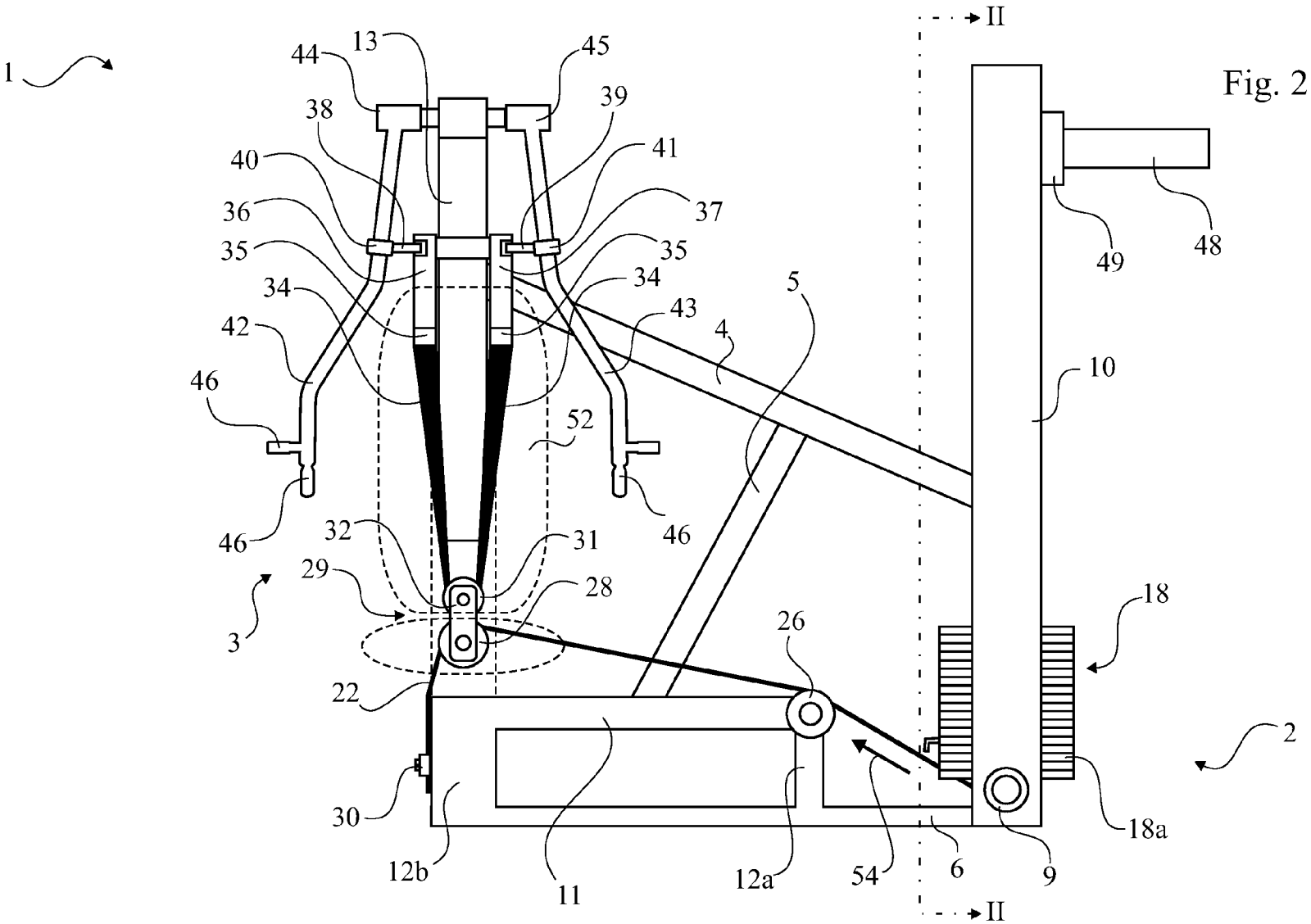
FIG. 2 shows the training machine of FIG. 1 in a negative movement position, where a person using the machine has been removed and where a seat with a supporting frame has been provided with broken lines for the sake of clarity.
Figure 3:
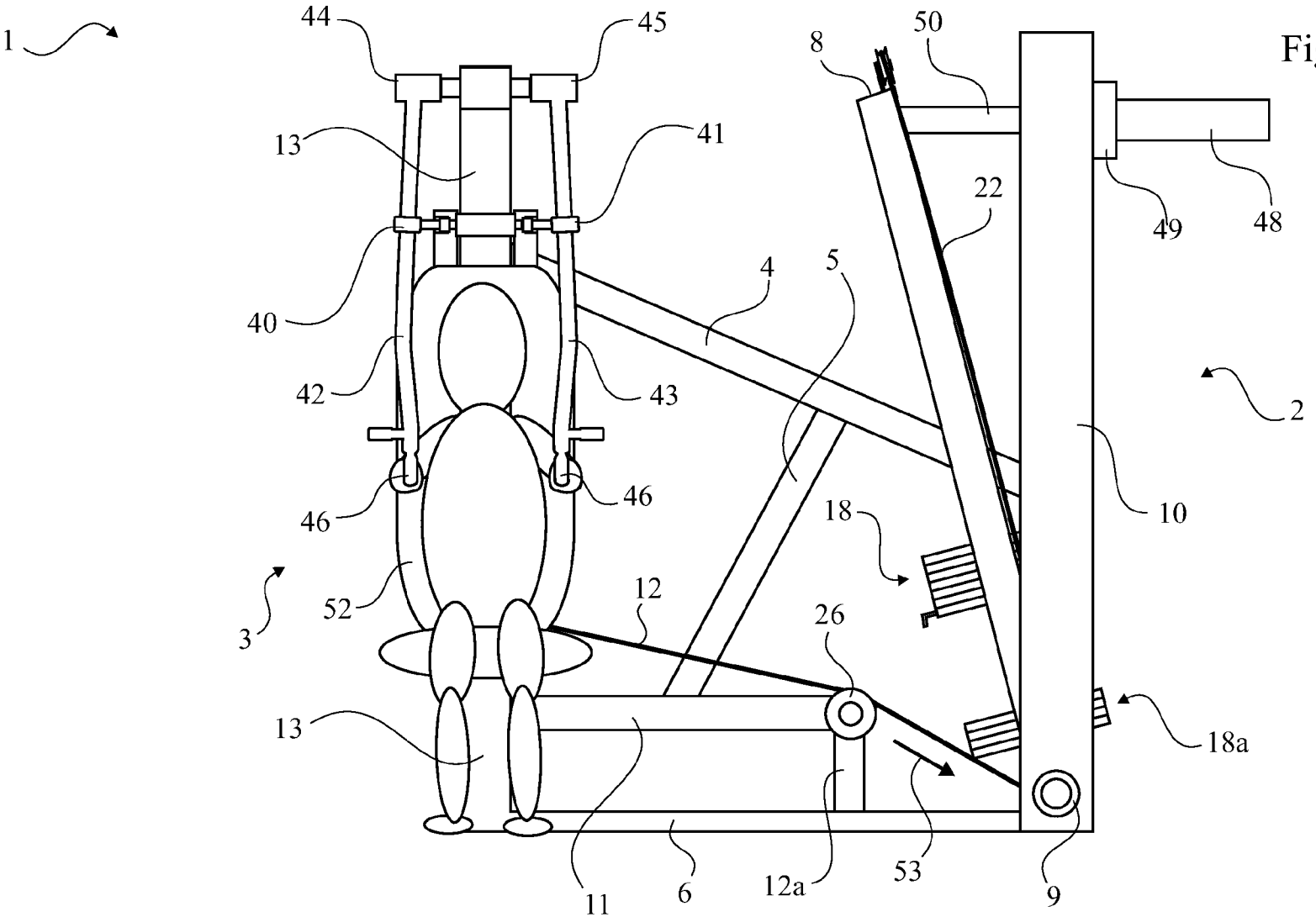
FIG. 3 shows the training machine of FIG. 1 in a positive movement position.
Figure 5:
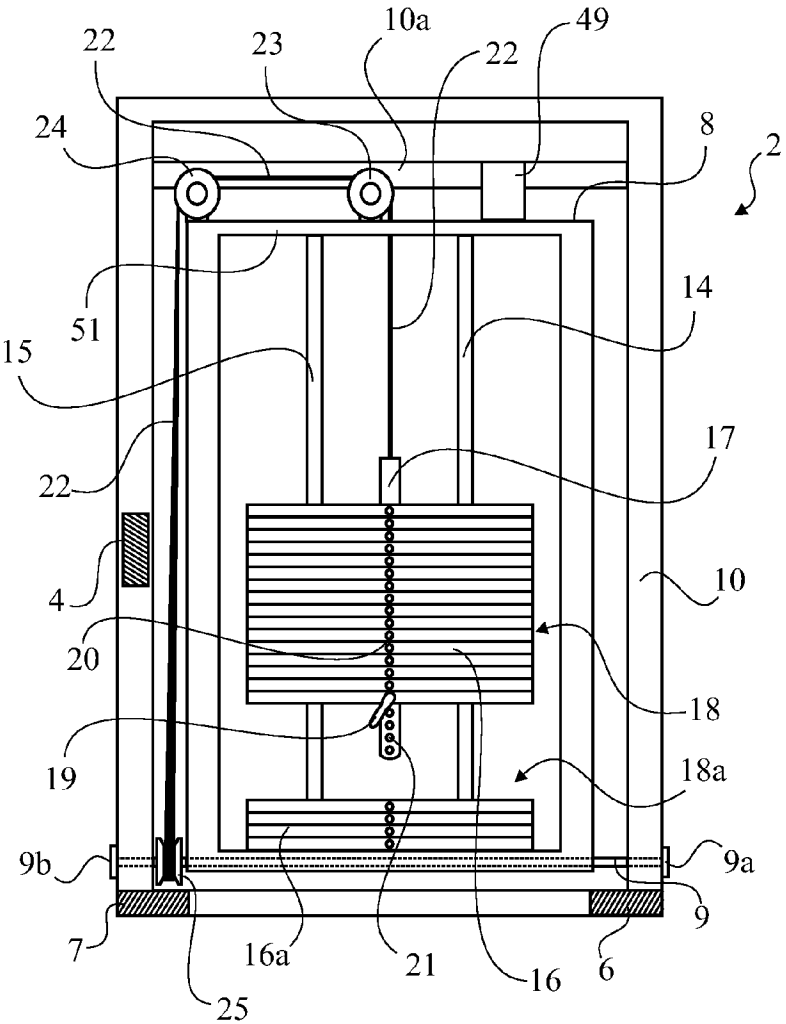
FIG. 5 shows a view, similar to the one of FIG. 4, of the machine, where the machine is in a position to perform a negative movement.
Figure 4:
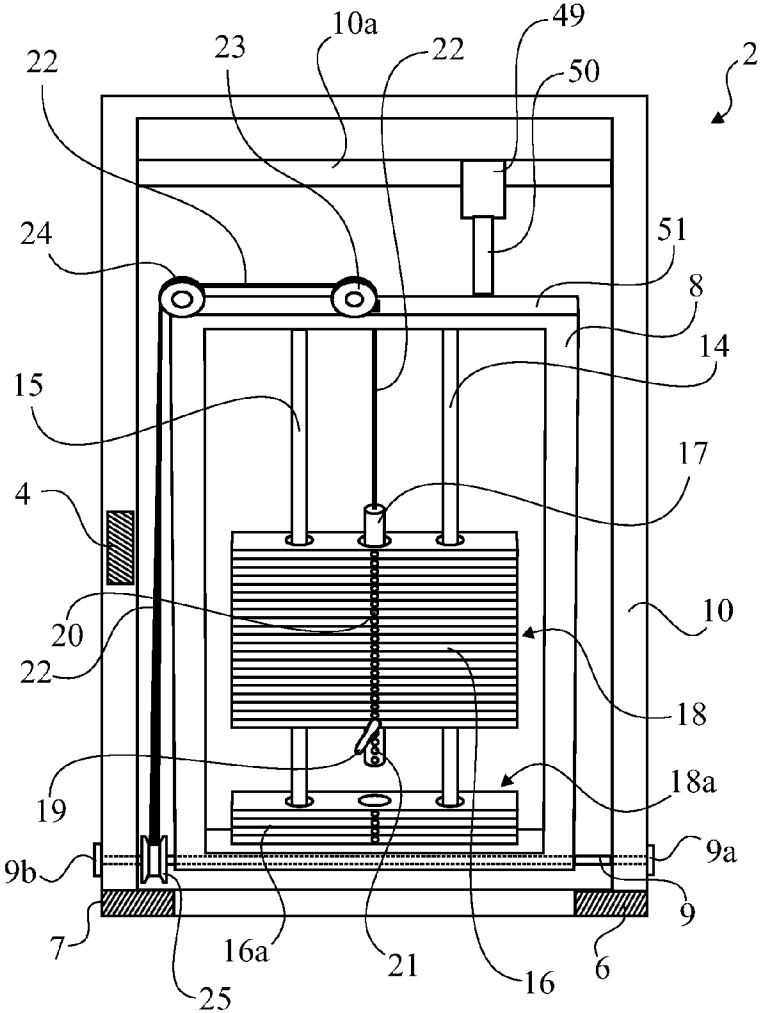
FIG. 4 shows a cross-section along the line II-II of FIG. 2, where the machine is in a position for a positive movement.

In FIGS. 1 to 7, a training machine 1 according to the invention for strength training and rehabilitation is shown, which machine comprises a weight stack section 2 and a training section 3, which are fixedly connected to each other by inclined beams 4 and 5, as well as fixedly connected beams 6 and 7 which are arranged in a horizontal plane at the lower portion of said sections 2 and 3. The weight stack section 2 has an inner, substantially rectangular frame portion 8 (see FIGS. 4 and 5), which is rotatably journalled at the bottom on a shaft 9 within an outer, substantially rectangular frame portion 10. The shaft 9 may at 9*a* and 9*b* be attached to the outer sides of the frame portion 10, and the inner frame 8 is freely rotatably journalled on this shaft 9. Instead of the shaft 9, pivots on both sides of the frame 8 may constitute an axis of oscillation for the frame 8. The shaft 9 may also be arranged parallel to the lower end of the frame beside the same.

A horizontal beam 11 is via vertical beams 12*a*, 12*b* fixedly connected to a beam, not shown, arranged between the beams 6, 7 and the frame construction 13 of the training section. The lower end of the inclined beam 5 is fixedly connected to the beam 11. The parts included in the frame construction of the training machine 1, which parts are firmly connected to each other, are advantageously welded to each other to achieve a stable construction, which will stand high loads with respect to both tension and pressure loads and vibrations.

Two parallel, substantially vertical guide bars 14 and 15 are at their ends attached to the frame 8 at the top and at the bottom. Weights 16, 16*a* run along these guide bars 14 and 15. The weights have besides openings for the guide bars also a centre opening for a lifting bar 17 (see FIGS. 4, 5), wherein a package 18 with a predetermined number of weights may be lifted by a pin 19 being put through an perpendicularly to the centre opening arranged opening 20 through the lowest weight 16 in the package 18 to be lifted, and the corresponding opening 21 in the lifting bar 17. Bearings, not shown, preferably ball or roller bearings, may be mounted in the openings for the guide bars 14 and 15 to reduce the friction at a displacement of the weights along the bars, when the inner frame has been turned to a predetermined inclined position, which will be described below. The weights 16*a* in the portion of the weight package 18*a*, which are not to be lifted, i.e. below the weight 16*a*, which is stopped by the pin 19, abut against the bottom portion of the frame 8. Lifting and lowering of the weight package 18 is performed by means of a torsion rigid belt 22, preferably made of the material Kevlar®, which belt runs via a roll 23 arranged on the upper beam of the inner frame portion 8 and is turned 90° and is moved further along the upper beam of the inner frame over a roll 24 so that the belt is again turned 90° in order then to run over and abut against an additional roll 25, which is arranged on the lower shaft 9 at the lower end of the frame 8. From the roll 25, which is arranged substantially in level with the shaft 9, the belt turns obliquely upwards over a roll 26 mounted on the beam 11 (see FIGS. 1-3). From the roll 26, the path of the belt extends somewhat upwards over a roll 28 with an equalization device 29 to a fastening device 30, which is arranged on a protrusion 12*c* on the beam 12*b*. Besides the roll 28, the equalization device 29 comprises an additional roll 31, which like the roll 28 is journalled in freely hanging linkage arms 32 and 33. An additional tension rigid belt 34, preferably made of the material Kevlar®, is at its ends through fastening devices 35 mounted to the lower ends of arcuately extending turning arms 36 and 37.

The equalization device 29 with the additional belt 34 has in a known manner been mounted to equalize the power from the arms of the training person at loading towards the arms 42 and 43 of the machine, which accordingly do not need to be moved away from the person by the same distance to achieve effect. This depends on the fact that a person is often not equally strong in both right and left arm.

At the opposite upper ends of the arms 36 and 37, linkage arms 37 and 39 are mounted, which are movable in all directions, e.g. by means of a ball-and-socket joint. The arms 38 and 39 are in turn at their other ends in all directions freely movably connected to couplings 40 and 41 mounted on pull and press arms 42 and 43, which in turn are freely turnably journalled at their upper ends on the frame construction 12 at 44 and 45, respectively. Handles 46 are provided at the lower ends of the arms 42 and 43. The turning arms 36 are journalled on a common through shaft 47, which is attached to the frame construction 13. The turning arms 36 are freely journalled independent of each other on said shaft 47. A stop 47*a* restrains the movements of the turning arms in one direction of rotation. In FIGS. 1 to 5, a hydraulic piston and cylinder device 48 with a motor 49 is shown. The piston and cylinder device 48 is mounted on a transverse beam 10*a* at the outer frame portion 10. The end 50*a* of the rod piston 50 of the piston and cylinder device 48 is journalled at the upper transverse beam 51 of the inner frame portion 8. By activating the piston and cylinder device 48, the inner frame 8 of the weight stack section 2 is forced to turn around the shaft 9. The hydraulic piston and cylinder device 48 is shown as an example of a device for turning the inner frame 8 in relation to the outer frame 10. Of course, other known devices for performing this operation may be used within the scope for the appending claims, such as for instance a linear electro motor, etc. According to the invention the inner frame 8 is turnable along a substantially horizontal axis of oscillation 9, which is arranged at the lower end of the inner frame 8. The piston and cylinder device 48, the rod piston 50 and the motor 49 are arranged at a predetermined distance above the geometric centre of the inner frame 8 in a vertical direction, when the inner frame 8 is in the vertical position, so that the upper end of the inner frame 8 is arranged to be moved to and fro from a predetermined angled position turned about the axis of oscillation and an essentially vertical position.

Figure 7:
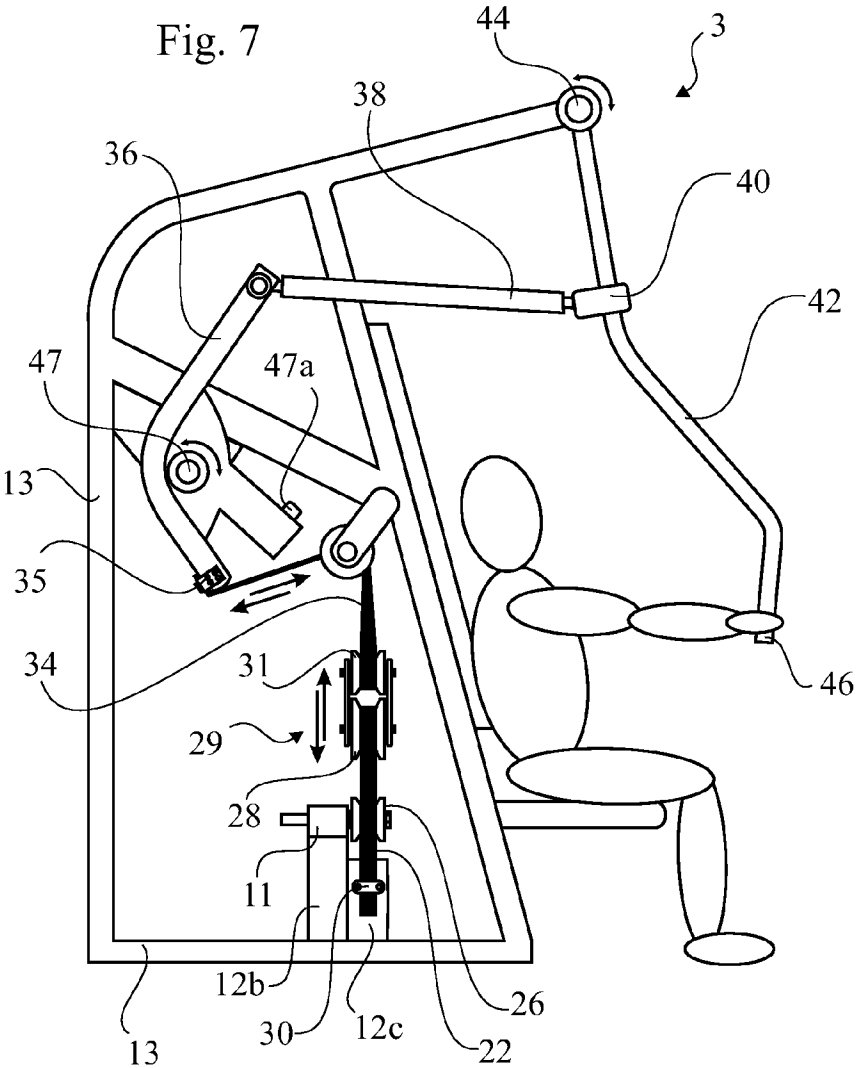
FIG. 7 shows a view similar to the one of FIG. 6, where the person performs either a positive or a negative movement.
Figure 6:
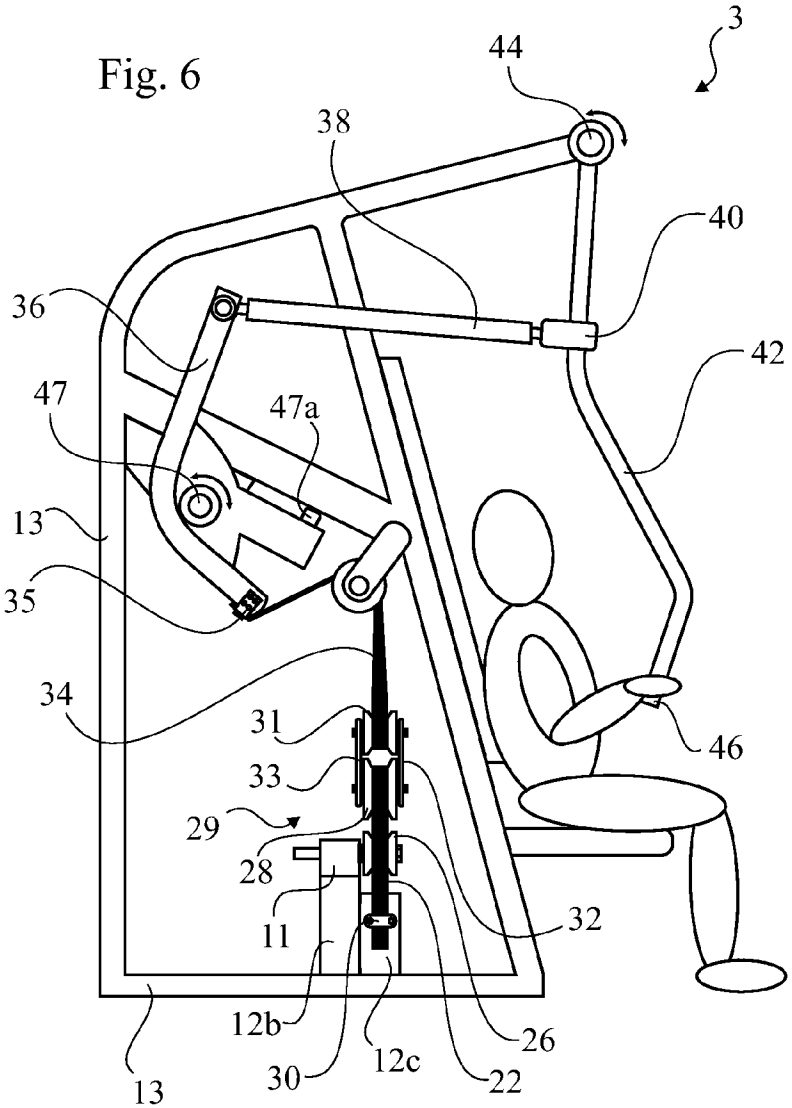
FIG. 6 shows a side view of the training machine of FIG. 1, where the user is in the position where the weights in the weight stack are lowered.

A person which is to train with the strength training device 1 according to the first embodiment of the invention sits down on the chair 52 and grips the handles 46 of the arms 42 and 43, as may be seen from FIGS. 1, 6 and 7. To facilitate the positive movement, i.e. the person presses the arms 42 and 43 outwards from the body, the inner frame is turned in accordance with FIGS. 3 and 4, so that the force necessary to lift the upper weight package 18 is reduced by the inclination of the inner frame 8, whereupon the upper weight package 18 slides on the guide bars 14 and 15 and a reduction of the force required to press the handles forwards may be reduced by up to more than 50%. The positive force required to lift the weights is essentially smaller than the negative force, i.e. in the order of more than 30%, more exactly about 40%. When the person begins the negative movement, i.e. the person moves the arms 42 and 43 inwardly towards the body to a stop/start position where the stop 47*a* abuts against the frame construction 13, the inner frame 8 is turned back to its original vertical position, in which the person achieves full load from the weight package 18. Turning of the inner frame by means of the piston and cylinder device 48 suitably occurs automatically by means of a control unit, not shown, which via sensors senses the movement of the belt 22 and turns the inner frame towards the position of FIG. 3, when the belt moves in the direction of the arrow 53 and towards the position of FIGS. 1 and 2, when the belt moves in the direction of the arrow 54.

At the embodiment shown of the training machine according to the invention, described above, it is achieved that the training person may either lift more weights than is possible with a normal, previously known machine, or lift more times with the same weight as was earlier used.

The training machine according to the invention may be modified within the scope of the appended claims.

The invention claimed is:

1. A training machine for strength training and rehabilitation comprising:

pull or press means which are arranged to be moved to-and-fro while a predetermined number of weights in a weight package via connection means are caused to be lifted and lowered, respectively, along an inner frame; and driving means in a continuous cycle by means of a first user exerted force towards said pull or press means, to lift said predetermined number of weights and by means of a second user exerted force towards said pull or press means, to lower said predetermined number of weights, wherein said first force is smaller than said second force, the inner frame is turnable along a substantially horizontal axis of oscillation, which is arranged at the lower end of the inner frame, and that said driving means is arranged at a predetermined distance above the geometric centre of the inner frame, so that the upper end of the inner frame is arranged to be moved to-and-fro from a predetermined angled position turned around said axis and an essentially vertical position.

2. A training machine according to claim 1, wherein said driving means is arranged at the upper end of the inner frame.

3. A training machine according to claim 1, wherein said axis of oscillation is arranged parallel to the lower, substantially horizontal side of the inner frame.

4. A training machine according to claim 1, wherein said frame is turnable about a shaft extending parallel to the inner frame.

5. A training machine according to claim 4, wherein said shaft extends through the inner frame.

6. A training machine according to claim 1, wherein said frame is turnable about pivots on both sides of said frame.

7. A training machine according to claim 1, wherein said driving means is an electric motor or a hydraulic piston and cylinder device.

* * * * *